United States Patent [19]

Spranger et al.

[11] 4,094,409

[45] June 13, 1978

[54] SAMPLE DISPLAY TRAY

[75] Inventors: Douglas M. Spranger, Brooklyn; Malcolm J. Brookes, New York, both of N.Y.; Paul J. Mulhauser, Paramus, N.J.

[73] Assignee: Seiko Time Corporation, New York, N.Y.

[21] Appl. No.: 785,924

[22] Filed: Apr. 8, 1977

[51] Int. Cl.[2] ..... B65D 1/36; B65D 85/40

[52] U.S. Cl. ..... 206/566; 24/73 J; 206/44.12; 206/301; 24/265 WS; D9/193

[58] Field of Search ..... 206/44 R, 44.12, 45.14, 206/301, 18, 329, 334, 341, 347, 382, 383, 566, 589; D9/193; 24/73 J, 241 SP, 265 WS

[56] References Cited

U.S. PATENT DOCUMENTS

| | | | |
|---|---|---|---|
| 1,872,649 | 8/1932 | Berg | 206/566 X |
| 1,957,274 | 5/1934 | Lederer | 24/115 R |
| 2,586,758 | 2/1952 | Zerr | 24/73 J |
| 2,633,619 | 4/1953 | Rodriguez | 24/241 SP |
| 2,964,937 | 12/1960 | Lautin | 24/73 J |
| 3,665,565 | 5/1972 | Kruger | 24/265 WS |
| 3,687,280 | 1/1970 | Fortannaz | 206/45.15 |

FOREIGN PATENT DOCUMENTS

| | | |
|---|---|---|
| 1,170,182 | 5/1964 | Germany. |
| 426,102 | 10/1947 | Italy. |

*Primary Examiner*—William Price
*Assistant Examiner*—Bruce H. Bernstein
*Attorney, Agent, or Firm*—Brumbaugh, Graves, Donohue & Raymond

[57] ABSTRACT

Apparatus for displaying articles is provided with a generally planar display surface having a pair of opposed parallel edge portions formed with spaced apart recesses. Each end of the article to be displayed is retained by a detachable clasp assembly which is adapted for releaseable retention within one of the edge portion recesses.

9 Claims, 4 Drawing Figures

SAMPLE DISPLAY TRAY

The invention relates to showcase display devices and in particular to sample display trays adapted releasably to retain for display a plurality of articles side-by-side on a display surface.

BACKGROUND OF THE INVENTION

Heretofore, various tray configurations have been suggested for the purpose of retaining on the tray a plurality of commercial items in displayable position. In U.S. Pat. No. 1,872,649 to Erdman W. Berg, the display panel is provided with a plurality of spaced apart ribs on its display face. The space between the ribs is just adequate for frictional retention of an article, such as a watchband, between adjacent rib pairs. This arrangement works properly when the display panel is situated horizontally but has the disadvantage that an abrupt movement of the panel or an effort to display the panel vertically tends to cause the items displayed to fall out of their respective slots between the ribs. Moreover, being quite easily removable, the display items are susceptible of theft in the absence of other more complicated display techniques.

These disadvantages are obviated by the present invention in providing a cam-type clasp to be secured over the end of the article to be displayed and which is retained on the sample tray within an opening formed at the edge of the display panel. Deliberate manipulation of the clasp is required to obtain the release of the article from the tray. Accordingly, the panel may be placed in any position without concern that the displayed articles will be shifted inadvertently as a result of either a sudden jolt or of the display angle of the tray.

SUMMARY OF THE INVENTION

The present invention provides a display panel having a pair of raised edge portions along two opposing parallel sides. Each of the edge portions is provided with a plurality of spaced apart recesses or openings. A transversely extending bead is formed within each of the openings and is releasably gripped by a corresponding clasp secured over an end of the article to be displayed. The clasp constitutes a slotted enclosure having a pivotally mounted sidewall with an inwardly depending finger to press against the article inserted within the enclosure.

BRIEF DESCRIPTION OF THE DRAWINGS

For a further understanding of the present invention, reference may be had to the accompanying drawings, in which.

BRIEF DESCRIPTION OF THE PREFERRED EMBODIMENTS

Figure 1:
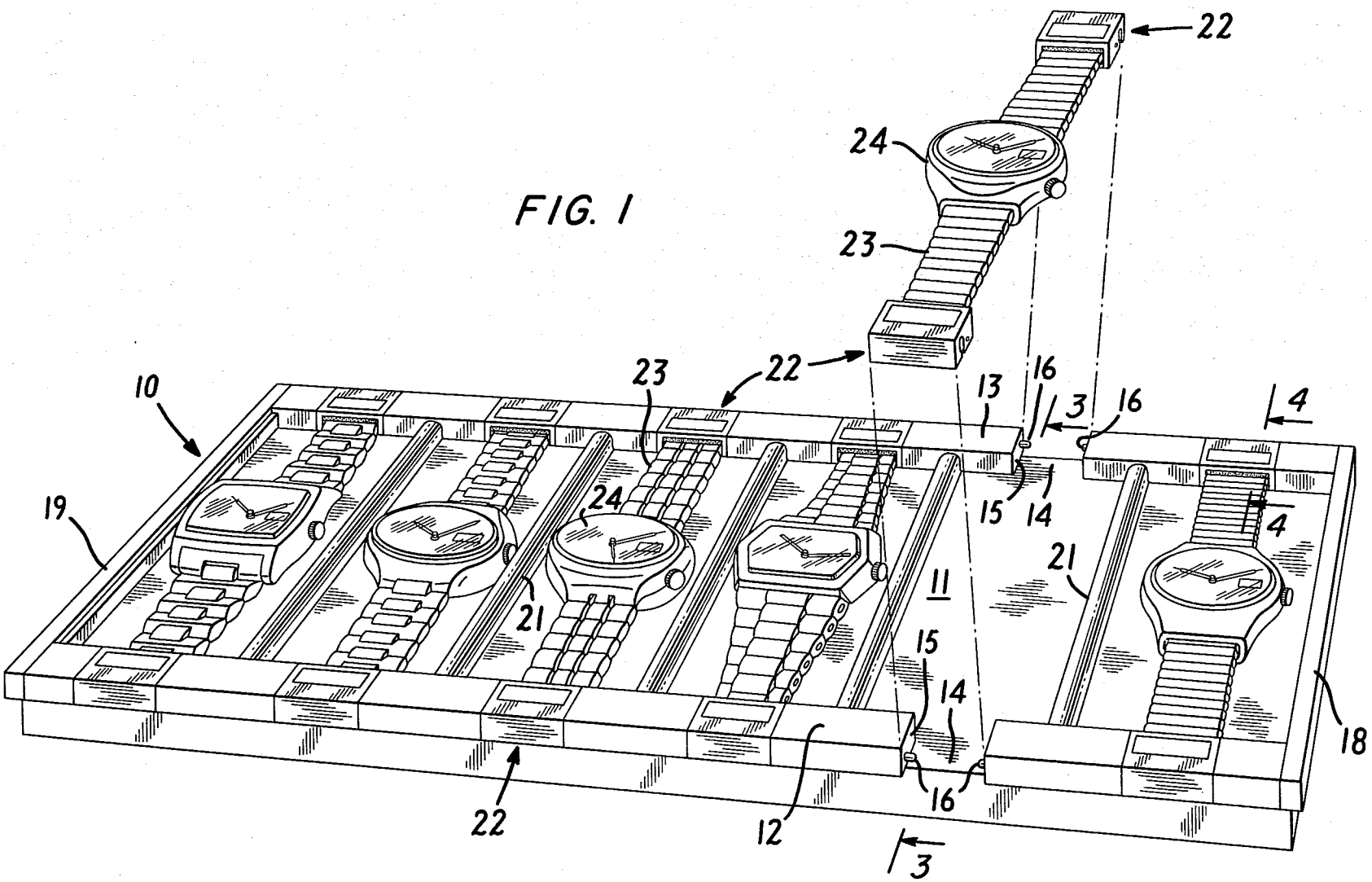
FIG. 1 is a perspective view of a sample display tray in accordance with the present invention.

Referring now to the drawings, and in particular to FIG. 1, there is shown a generally rectangular tray 10 having a display surface 11 which is provided with raised edge portions 12 and 13 along opposite parallel sides. In the present embodiment, the edge portions are coextensive with the tray and are each formed with a plurality of spaced apart recesses or openings 14. The openings located along one edge of the tray are aligned with corresponding openings on the opposite parallel edge of the tray. The edge portions may be formed integrally with the tray surface or may be bonded or otherwise affixed along the tray edges. The openings 14 may be in the form of slots as shown or may consist of laterally extending recesses formed in the raised edge portions.

Figure 3:
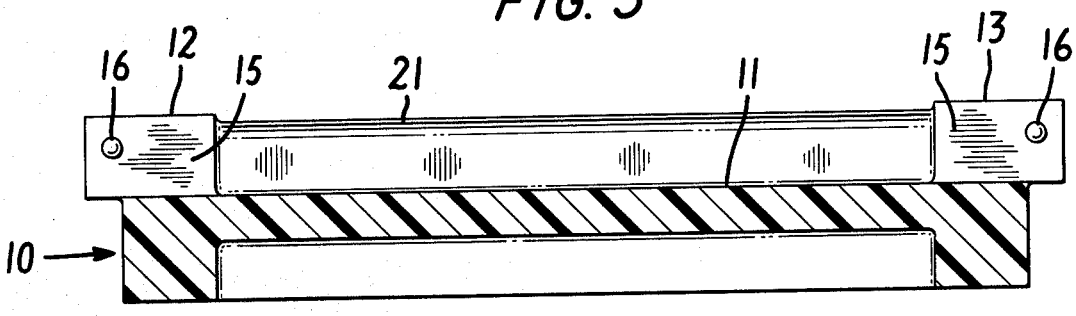
FIG. 3 is a view of the tray taken along the line 3—3 of FIG. 1.

As shown in FIGS. 1 and 3, opposing sidewalls 15 of the openings 14 are each provided with an outwardly protruding boss 16 to be gripped releasably by a suitable clasp affixed to articles to be displayed, as described below. The bosses 16 are aligned to extend substantially directly toward each other. Where desired, a continuous rod or bead traversing the opening 14 between the sidewalls 15 may be substituted for the bosses.

Where desired, the ends of the try 10 may be closed with raised edges 18 and 19. A plurality of ribs 21 may also be formed in, or otherwise affixed to the tray display surface to designate parallel display areas on the surface 11. In the embodiment of FIG. 1, these ribs 21 extend perpendicularly between the opposed edge portions 12 and 13.

Figure 2:
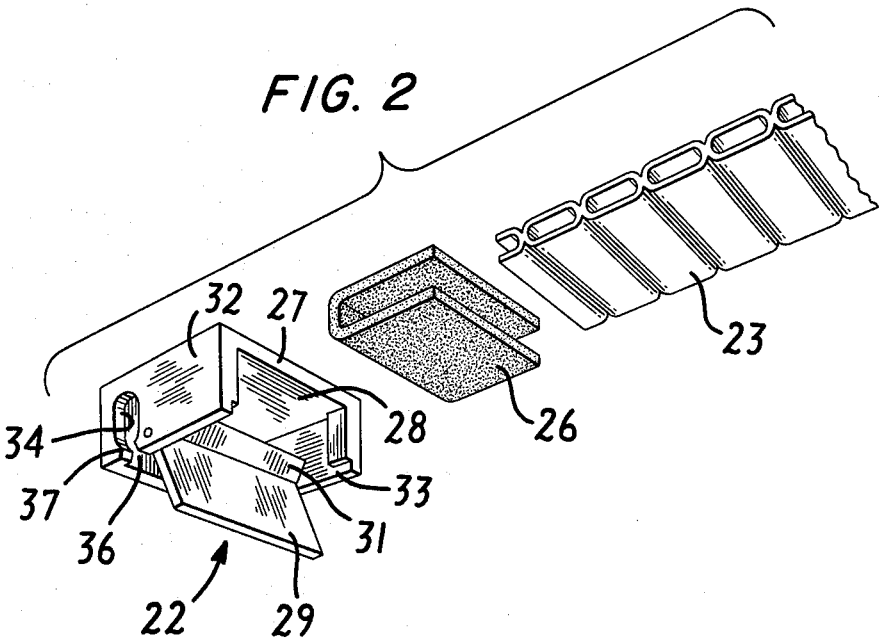
FIG. 2 is an exploded perspective view of a watchband and associated clasp for releasably securing the watchband to the tray of FIG. 1.

Turning now to FIG. 2, there is shown a clasp assembly 22 which is adapted to be attached to the free end of a watchband 23 of a watch 24 to be displayed in the tray. In preparation for mounting a sample watch in the tray, the watchband 23 is cut to a predetermined length on each side of the watch. A substantially U-shaped rubber sleeve 26 is slipped over and covers each free end of the band 23. The rubber sleeve 26 and the enclosed end of the watchband 23 are then gripped or retained by a suitable clasp element 27. In the preferred embodiment, the clasp 27 takes the form of a slotted enclosure or hollow boxlike structure having an open end 28 into which the sleeve 26 is inserted to enter toward the interior. The enclosure is provided with a pivotally mounted sidewall or pivot member 29 having a generally inwardly depending finger 31 for engaging and disengaging the outer surface of the rubber sleeve 26 when it is within the clasp.

Figure 4:
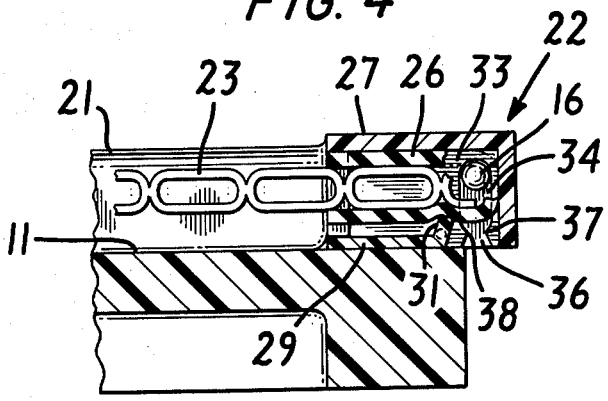
FIG. 4 is a view of the tray and clasp taken along the line 4—4 of FIG. 1.

With reference to FIGS. 2 and 4, opposite sidewalls 32 and 33 of the enclosure 27 are each provided with a transverse slot 34. Each of the slots has a constricted throat portion 36 of a width just slightly less than the width of the bosses 16. In mounting the enclosure 27 on the tray, it is placed in the tray so that the bosses 16 are forced through the throat portion 36 and into the slots 34. The enclosure is thereby releasably clasped to the tray in the opening 14.

The sidewalls of the enclosure which contain the slots 34 are somewhat reslient to permit the opposed surfaces defining the throat 36 to be moved radially outwardly with respect to the boss 16 to permit it to pass into the slot 34 with the application of suitable pressure. Such radially outward movement is facilitated by generally V-shaped cam surfaces 37 and 38 on each side of the slot, the vertex of each of which protrudes inwardly toward the other to define the throat 36.

The articles to be displayed are prepared to be placed in the tray 10 as follows: The watchband 23 is clipped to the desired length and the U-shaped rubber sleeve 26 is slipped over the trimmed edge as shown in FIG. 4. The sleeve is then inserted into the enclosure 27 through the opening 28 and under the pivot member 29 and the finger 31. The enclosure 27 is then positioned in the openings 14 and pressed downwardly to force the bosses 16 into the slots 34 as described above. As shown in FIG. 4, the display surface 11 engages the outer surface of the pivot member 29 and serves to retain it in its closed position while the watch is being displayed. When the pivot member is closed, it and, in particular, the finger 31 press respectively against and into the rubber sleeve 26 to lock the sleeve into the enclosure. Moreover, the angle of dependency of the finger 31 is such that it applies a constant generally inwardly directed force to the sleeve and to the enveloped watchband surfaces. Frictional forces and inward deformation of the sleeve developed at the interface between the watchband and the sleeve facilitate retention of the sleeve and watchband within the enclosure 27.

When it is desired to open the enclosure 27 to release the sleeve and watchband, the member 29 is pivoted outwardly, or counterclockwise as viewed in FIG. 4. This movement causes the finger 31 to be urged to the left, toward the opening 28, thereby to facilitate ejection of the sleeve 26 and watchband 23 from the enclosure.

The pivot member 29 might be provided with more than one inwardly depending finger with which to engage the sleeve 26. In that event one of the fingers, such as the finger 31, may be located to fit adjacent the inner end of the sleeve 26 between it and the enclosure wall when the pivot member is closed. This arrangement would further facilitate ejection of the sleeve when the pivot member 29 is opened.

The foregoing clasp arrangement permits the trays 10 to be turned to nearly any suitable display position, vertical or otherwise, without fear that watches on display will inadvertently shift position or otherwise be released. The pivot member 29 cannot be opened to release the sleeve 26 and watchband 23 until the enclosure 27 has been raised from the display surface 11 enough to permit the bosses 16 to pass outwardly through the throat 36 to disengage from the slots 34.

Of course, each item on display in the tray may be provided with a pair of the foregoing clasp assemblies. Each of the parallel display areas defined by the ribs 21 of the tray may therefore contain one item clasped at each end into opposed pairs of the openings 14.

In the present embodiment, each of the enclosures 27 extends laterally outwardly beyond the edge of the tray 10 in order to permit its being gripped from below to lift it off of the tray. Likewise, the raised edge portions 12 and 13 and the ends 18 and 19 may also overhang the edge of the tray bottom. The resulting overhanging lateral surfaces constitute an outwardly projecting peripheral flange to support the tray in a suitable display case, as desired.

It will be understood that display trays according to the present invention are susceptible of various modifications, changes and adaptations as will occur to those skilled in the art. It is, therefore, intended that the scope of the present invention is not to be limited except as defined by the following claims.

What is claimed is:

1. Apparatus for releasably holding articles to be displayed comprising:

a generally planar display surface having a raised edge portion formed with a recess;

a clasp assembly to be releasably secured over one end of an article and consisting of a slotted enclosure having a pivotally mounted member formed with a generally inwardly depending finger movable upon pivoting of said member alternately to press against and release the article inserted within the slot, a sidewall of said enclosure being resiliently formed with a throated detent opening outwardly to receive a corresponding boss element formed on and projecting away from a corresponding sidewall of said recess in the edge portion of the display surface, the width of the throat of said detent being slightly less than the diameter of said boss.

2. The apparatus of claim 1 in which said depending finger moves generally laterally inwardly relative to said slotted enclosure upon being pressed against said one end of an article inserted therein, thereby to tend to move the article further into said enclosure.

3. The apparatus of claim 1 in which said pivotal member is urged by the display surface to pivot against the article within the slot of the enclosure when the enclosure is inserted into said recess formed in the edge portion of the display surface.

4. The apparatus of claim 1 in which said recess contains a pair of opposed inwardly projecting boss elements and said enclosure is formed with a corresponding pair of said throated detents.

5. The apparatus of claim 4 in which the end of the article inserted into the slot of said enclosure is covered by a substantially U-shaped rubber sleeve.

6. The apparatus of claim 5 in which the display surface comprises a pair of parallel raised edge portions each of which is recessed releasably to retain therein one of said slotted enclosures secured over each end of the article to be displayed.

7. The apparatus of claim 6 in which the parallel raised edge portions are each provided with a plurality of spaced apart openings, each of which releasably retains therein one of said slotted enclosures whereby a plurality of articles may be simultaneously displayed on the display surface.

8. The apparatus of claim 7 in which said display surface is provided with a plurality of substantially parallel spaced apart rib elements each of which extends between said parallel raised edge portions to separate adjacent articles being displayed on the surface.

9. The apparatus of claim 8 in which the display surface is formed as part of a tray each of the portions comprising a laterally outwardly extending peripheral flange to support the tray in a display position.

* * * * *